United States Patent [19]

Frame

[11] Patent Number: 4,498,978

[45] Date of Patent: Feb. 12, 1985

[54] CATALYTIC OXIDATION OF MERCAPTAN IN PETROLEUM DISTILLATE

[75] Inventor: Robert R. Frame, Glenview, Ill.

[73] Assignee: UOP Inc., Des Plaines, Ill.

[21] Appl. No.: 555,930

[22] Filed: Nov. 29, 1983

[51] Int. Cl.[3] ..... C10G 27/10; C10G 29/00

[52] U.S. Cl. ..... 208/207; 208/189; 502/163

[58] Field of Search ..... 208/207, 189; 502/163

[56] References Cited

U.S. PATENT DOCUMENTS

| | | | |
|---|---|---|---|
| 2,083,917 | 6/1937 | McGee | 208/189 |
| 2,988,500 | 6/1961 | Gleim et al. | 208/206 |
| 3,686,094 | 8/1972 | Laleuf et al. | 208/207 |
| 3,783,125 | 1/1974 | Ordrey et al. | 208/189 |
| 4,290,916 | 9/1981 | Carlson | 502/163 |
| 4,290,917 | 9/1981 | Carlson | 502/163 |

*Primary Examiner*—Delbert E. Gantz
*Assistant Examiner*—Helane Myers
*Attorney, Agent, or Firm*—William H. Page, II; John G. Cutts, Jr.

[57] ABSTRACT

A process for sweetening a sour hydrocarbon fraction containing mercaptan which comprises reacting mercaptans contained in the hydrocarbon fraction with an oxidizing agent by passing said hydrocarbon fraction and said oxidizing agent into contact with a heterogeneous admixture of a metal chelate mercaptan oxidation catalyst and a solid desiccant.

11 Claims, 1 Drawing Figure

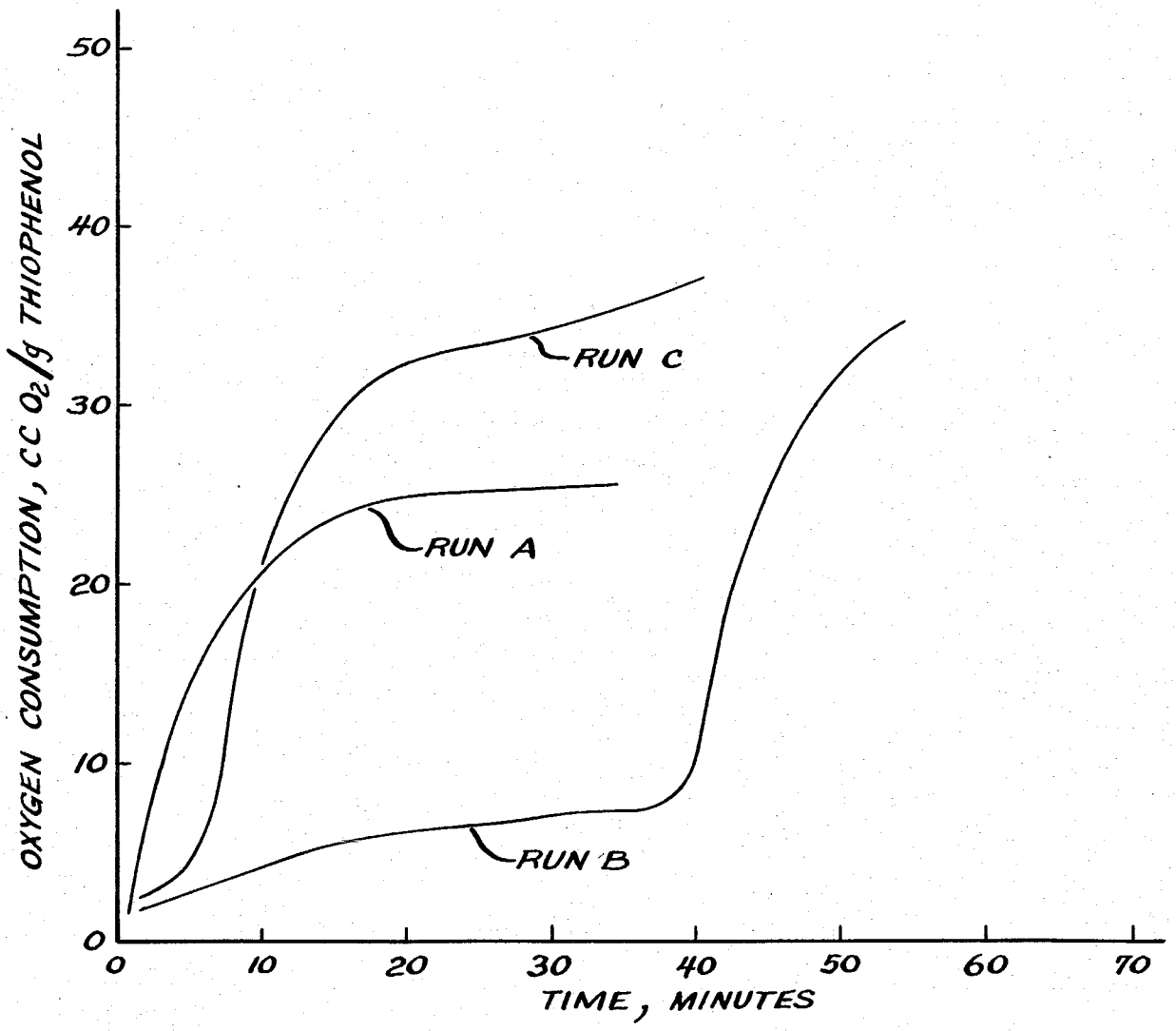
OXYGEN CONSUMPTION, CC O2/g THIOPHENOL
50
40
30
20
10
0
0
10
20
30
40
50
60
70
TIME, MINUTES
RUN C
RUN A
RUN B

CATALYTIC OXIDATION OF MERCAPTAN IN PETROLEUM DISTILLATE

BACKGROUND OF THE INVENTION

Field of the Invention

The field of art to which the present invention pertains is the treatment of sour petroleum distillates or fractions, the treatment being commonly referred to as sweetening. More specifically, the present invention relates to treating sour petroleum distillates with a heterogeneous admixture of a supported metal chelate mercaptan oxidation catalyst and a solid desiccant.

Information Disclosure

Processes for the treatment of a sour petroleum distillate wherein said distillate is treated, in the presence of an oxidizing agent at alkaline reaction conditions, with a supported metal phthalocyanine catalyst dispersed on a fixed bed in a treating or reaction zone, have become well known and widely accepted in the industry. The treating process is typically designed to effect the catalytic oxidation of offensive mercaptans contained in the sour petroleum distillate with the formation of innocuous disulfides. Gasoline, including natural, straight run and cracked gasolines, is the most frequently treated sour petroleum distillate. Other sour petroleum distillates include the normally gaseous petroleum fraction as well as naphtha, kerosene, jet fuel, fuel oil and the like.

A commonly used continuous process for treating sour petroleum distillates entails treating the distillate in contact with a metal phthalocyanine catalyst dispersed in an aqueous caustic solution to yield a doctor sweet product. The sour distillate and the catalyst-containing aqueous caustic solution provide a liquid-liquid system wherein mercaptans are converted to disulfides at the interface of the immiscible solutions in the presence of an oxidizing agent—usually air. Sour petroleum distillates containing more difficultly oxidizable mercaptans are more effectively treated in contact with a metal phthalocyanine catalyst disposed on a high surface area adsorptive support—usually a metal phthalocyanine on an activated charcoal. The distillate is treated in contact with the supported metal phthalocyanine catalyst at oxidation conditions in the presence of an alkaline agent. One such process is described in U.S. Pat. No. 2,988,500. The oxidizing agent is most often air admixed with the distillate to be treated, and the alkaline agent is most often an aqueous caustic solution charged continuously to the process or intermittently as required to maintain the catalyst in a caustic-wetted state.

The prior art recognizes that there are limitations on the ability to treat a sour petroleum distillate with a catalytic composite consisting of a metal phthalocyanine disposed on a carrier material such as the relatively short-catalyst life and the required utilization of alkaline reagents. However, the prior art does not disclose or suggest that a sour mercaptan-containing hydrocarbon distillate may be more effectively treated by a method comprising contacting the distillate at oxidation conditions with a heterogeneous admixture of a supported metal chelate mercaptan oxidation catalyst and a solid desiccant. I have discovered surprising and unexpected results when utilizing a heterogeneous admixture of a supported metal chelate catalyst and a solid desiccant to sweeten hydrocarbon distillate.

SUMMARY OF THE INVENTION

One embodiment of the present invention is a process for sweetening a sour hydrocarbon fraction containing mercaptan which comprises reacting mercaptans contained in the hydrocarbon fraction with an oxidizing agent by passing the hydrocarbon fraction and the oxidizing agent into contact with a heterogeneous admixture of a supported metal chelate mercaptan oxidation catalyst and a solid desiccant.

Other embodiments of the present invention encompass further details such as feedstocks, catalyst carrier materials, solid desiccants, preferred catalyst compositions and process operating conditions, all of which are hereinafter disclosed in the following discussion of each of these facets of the invention.

BRIEF DESCRIPTION OF THE DRAWING

The drawing is a graphical comparison of the performance of the process of the present invention with performances of processes of the prior art.

DETAILED DESCRIPTION OF THE INVENTION

I have discovered that a heterogeneous admixture of a supported metal chelate catalyst and a solid desiccant displays improved sweetening of hydrocarbon distillates. The outstanding characteristics of my invention have permitted the sweetening of hydrocarbons without the addition of alkaline reagents while maintaining extended mercaptan conversion activity. The prior art has always relied upon the presence of alkaline reagents to retard the rapid deactivation of metal chelate catalysts during hydrocarbon sweetening. The presence of alkaline reagents was always considered to be a necessary element for the sweetening reaction and one which was to be tolerated. The usage of alkaline reagents was undesirable in that the provision of the alkaline reagent was an added expense, the post-treatment separation of the alkaline reagent from the product had to be ensured, the compatibility of the processing unit had to be maintained with regard to the chemically agressive characteristics of many of the alkaline reagents and the spent alkaline reagents had to be disposed of in an environmentally acceptable manner.

As mentioned above, the prior art has long recognized the ability of phthalocyanine catalyst to oxidize mercaptans, but those skilled in the art have failed to discover the surprising and totally unexpected results of my invention.

The supported metal chelate catalyst of the present invention comprises a carrier material and the catalytically active metal chelate. The metal chelate mercaptan oxidation catalyst employed as a component of the catalytic composite of this invention can be any of the various metal chelates known to the treating art as effective to catalyze the oxidation of mercaptans contained in a sour petroleum distillate with the formation of polysulfide oxidation products. Said chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corriniod catalysts as described in U.S. Pat. No. 3,252,892, e.g., cobalt corrin sulfonate; chelate organo-metallic catalysts such as described in U.S. Pat. No. 2,918,426, e.g., the condensation product of an aminophenol and a metal of Group VIII; and the like. Metal phthalocyanines are a preferred class of metal chelate mercaptan oxidation catalysts.

The carrier material herein contemplated includes the various and well known adsorbent materials in general use as catalyst supports. Preferred carrier materials include the various charcoals produced by the destructive distillation of wood, peat, lignite, nut shells, bones, and other carbonaceous matter, and preferably such charcoals as have been heat treated, or chemically treated, or both, to form a highly porous particle structure of increased adsorbent capacity, and generally defined as activated charcoal. Said carrier materials also include the naturally occurring clays and silicates, for example, diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof, like silica-alumina, silica-zirconia, alumina-zirconia, etc. Any particular carrier material is selected with regard to its stability under conditions of its intended use. For example, in the treatment of a sour petroleum distillate, the carrier material should be insoluble in, and otherwise inert to, the petroleum distillate at conditions typically existing in the treating zone. Charcoal, and particularly activated charcoal, is preferred because of its capacity for metal phthalocyanine and because of its stability under treating conditions. However, it should be observed that the method of this invention is also applicable to the preparation of a metal chelate composited with any of the other well known carrier materials, particularly the refractory inorganic oxides.

The metal phthalocyanines which may be employed to catalyze the oxidation of mercaptans contained in sour petroleum distillates generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, nickel phthalocyanine, platinum phthalocyanine, palladium phthalocyanine, copper phthalocyanine, silver phthalocyanine, zinc phthalocyanine, tin phthalocyanine, and the like. Cobalt phthalocyanine, iron phthalocyanine, manganese phthalocyanine and vanadium phthalocyanine are particularly preferred. The metal phthalocyanine is more frequently employed as a derivative thereof, the commercially available sulfonated derivatives, e.g., cobalt phthalocyanine monosulfonate, cobalt phthalocyanine disulfonate or a mixture thereof being particularly preferred. The sulfonated derivatives may be prepared, for example, by reacting cobalt, vanadium, or other metal phalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

The composite of metal chelates and a carrier may be prepared in any suitable manner. In one method the carrier may be formed into particles of uniform or irregular size and shape and the carrier is intimately contacted with a solution of phthalocyanine catalyst. An aqueous or alkaline solution of the phthalocyanine catalyst is prepared and, in a preferred embodiment, the carrier particles are soaked, dipped, suspended or immersed in the solution. In another method, the solution may be sprayed onto, poured over or otherwise contacted with the carrier. Excess solution may be removed in any suitable manner and the carrier containing the catalyst allowed to dry at ambient temperature, dried in an oven or by means of hot gases passed thereover, or in any other suitable manner. In general it is preferred to composite as much phthalocyanine with the carrier as will form a stable composite, although a lesser amount may be so deposited, if desired. In one preparation, a cobalt phthalocyanine sulfonate was composited with activated carbon by soaking granules of carbon in phthalocyanine solution. In another method, the carrier may be deposited in the treating zone and the phthalocyanine solution passed therethrough in order to form the catalyst composite.

In accordance with the present invention, the supported metal chelate catalyst is utilized in a heterogeneous admixture with a solid desiccant. The solid desiccants useful for the present invention may be of any type known to those skilled in the art of performing dehydration. Thus, anhydrous salts such as anhydrous magnesium sulfate may be used. Furthermore, metal oxides which may be hydrated to metal hydroxides may also be used. Other suitable desiccants are classified as crystalline aluminosilicates or zeolites which display the ability to become associated with water molecules. Such zeolites are well known to those skilled in the art. In general, the desiccant of the present invention is a dehydrating agent which is solid under the conditions of the hydrocarbon oxidation process.

A preferred method of contacting the supported metal chelate mercaptan oxidation catalyst and the solid desiccant with the hydrocarbon feedstock is to install a physical admixture of supported catalyst and solid desiccant in a fixed bed inside the treating zone. The method of employing beds of solid material in treating zones is well known and need not be described in detail herein.

Treating of the sour hydrocarbon distillate in a treating zone generally is effected at ambient temperature, although elevated temperature may be used but will not generally exceed about 300° F. Atmospheric pressure is usually employed, although super-atmospheric pressure up to about 1000 psig may be employed if desired. The time of contact in the treating zone may be selected to give the desired reduction in mercaptan content and may range from about 0.1 to about 48 hours or more, depending upon the size of the treating zone, the amount of catalyst and desiccant and the particular hydrocarbon distillate being treated. More specifically, contact times equivalent to a liquid hourly space velocity from about 0.5 to about 15 or more are effective to achieve a desired reduction in the mercaptan content of a sour hydrocarbon distillate.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing gas may be employed. In fixed bed treating operations, the sour petroleum distillate may be passed upwardly or downwardly through the admixture of catalyst and desiccant. The sour petroleum distillate may contain sufficient entrained air, but generally added air is admixed with the distillate and charged to the treating zone concurrently therewith. In some cases, it may be of advantage to charge the air separately to the treating zone and countercurrent to the distillate separately charged thereto.

An optional component of the catalyst is a quaternary ammonium salt which is represented by the structural formula:

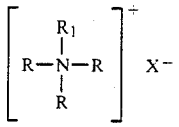

wherein R is a hydrocarbon radical containing up to about 20 carbon atoms and selected from the group consisting of alkyl, cycloalkyl, aryl, alkaryl and aralkyl, $R_1$ is a substantially straight chain alkyl radical containing from about 5 to about 20 carbon atoms, and X is an anion selected from the group consisting of halide, nitrate, nitrite, sulfate, phosphate, acetate, citrate and tartrate. $R_1$ is preferably an alkyl radical containing from about 12 to about 18 carbon atoms, at least one R is preferably benzyl, and X is preferably chloride. Preferred quaternary ammonium salts thus include benzyldimethyldodecylammonium chloride, benzyldimethyltetradecylammonium chloride, benzyldimethylhexadecylammonium chloride, benzyldimethyloctadecylammonium chloride, and the like. Other suitable quaternary ammonium salts are disclosed in U.S. Pat. No. 4,157,312 which is incorporated herein by reference.

The catalyst utilized in the present invention preferably contains a metal chelate in the amount from about 0.01 to about 20 weight percent of the finished catalyst. In the event that the catalyst contains a quaternary ammonium salt, it is preferred that said salt is present in an amount from about 1 to about 50 weight percent of the finished catalyst.

As is well known, the oxidation of mercaptans to disulfides produces water as a co-product. In the prior art the production of water from this oxidation was not considered to be detrimental to the activity of the metal chelate catalysts and furthermore was not critical in the usual case whereby the desired alkaline reagent charged to the reaction zone was aqueous sodium hydroxide or some other aqueous alkaline reagent. However, the addition of alkaline reagents is an undesirable, although previously necessary, element for the successful operation of a stable metal chelate catalyst. Without the beneficial stabilizing effect of alkaline reagents, I have discovered that the water produced during the oxidation of mercaptan containing hydrocarbons contributes to the instability of metal chelate catalysts. I have accordingly discovered that metal chelate catalyst stability may be greatly improved by performing the mercaptan oxidation in the presence of a solid desiccant which serves to remove a significant portion of the water.

In the process of the present invention, the mercaptan oxidation is performed in the presence of a heterogeneous admixture of a supported metal chelate mercaptan oxidation catalyst and a solid desiccant. In caustic-free mercaptan oxidations, the life of the metal chelate catalysts is shortened by toxin molecules which, it is believed, are formed from the mercaptans. The principal oxidation product is a disulfide and disulfides are not believed to be toxins. The resulting toxins are minor oxidation products but relatively minor amounts are sufficient to cause a noticeable catalyst deactivation. It is believed that the low levels of water of reaction maintained by the desiccant suppress the toxin-forming chemistry. I have discovered, however, that at even lower concentrations of water the oxidation of mercaptans to disulfides is inhibited, leading to a loss in activity at least as severe as that arising from the water-induced toxins. Thus, the benefits of the present invention are enjoyed when the water level in the oxidation zone is reduced but not reduced to the very low levels which inhibit mercaptan oxidation to disulfides. Therefore, the amount of desiccant which will beneficially promote the oxidation of mercaptans while utilizing a metal chelate catalyst is that which is less than the amount which would cause instability of the catalyst and greater than the amount required to retard deactivation. The precise amount of desiccant required on a case by case basis may be readily determined by those skilled in the art who are now aware of my discovery. Since the particular aechanism of my invention is not exactly known, an exact correlation, or a range for that matter, between the amount of desiccant required for a given catalyst system is unattainable at this time. However, it is believed with the aid of the teachings herein and the explanations in the following example that those skilled in the art will be able to enjoy the benefits of the present invention with only a modicum of adaptation to any specific sweetening process.

The following example is given to illustrate further my process for sweetening a sour hydrocarbon fraction containing mercaptan. The example is not to be construed as an undue limitation on the generally broad scope of the invention as set out in the appended claims and is therefore intended to be illustrative rather than restrictive.

EXAMPLE

A laboratory apparatus was assembled which permitted the measurement of oxygen consumed in a stirred reaction zone, which for purposes of the following test, is defined as the oxygen uptake. A batch of supported metal chelate mercaptan oxidation catalyst was prepared and which catalyst contained cobalt and manganese phthalocyanine supported on a charcoal carrier material. In the first run, 50 cc of isooctane, 0.1 gram of the hereinabove described charcoal-supported catalyst and 2 cc of thiophenol were charged to the laboratory apparatus. The desired effect is to maximize the quantity of oxygen uptake in the oxidation of thiophenol. The reaction zone was maintained at a temperature of about 20° C. and a pressure of 1 atmosphere. The oxygen consumption was recorded for the first run as a function of time and these results are presented in the drawing as Run A. The stoichiometric amount of oxygen required to oxidize thiophenol is about 50 cc of oxygen at standard conditions per gram of thiophenol. From the curve representing Run A in the drawing, it can be seen that the oxygen consumption was about 25 cc/gram of thiophenol after about 30 minutes and no longer increasing. Run A represents a typical prior art oxidation reaction and therein only approximately 50% of the thiophenol was oxidized before the oxidation catalyst became essentially deactivated.

In the second run, hereinafter Run B, 50 cc of isooctane, 0.1 gram of the hereinabove described charcoal-supported catalyst, 2 cc of thiophenol and 0.2 gram of molecular sieve Type 5A which is available from the Union Carbide Corporation, were charged to the laboratory apparatus. The reaction zone was maintained at the same temperature and pressure conditions as in Run A. After about 35 minutes the oxidation of the thiophenol was significantly less than that observed for Run A after a similar amount of time. Then 1 cc of water was added to the reaction zone and a rapid increase in the oxidation rate of thiophenol was observed. The oxygen consumption was recorded as a function of time and these results are presented in the drawing and identified as Run B. From the curve representing Run B in the drawing, it can be seen that the rate of thiophenol oxidation was very slow during the first 35 minutes and after the addition of 1 cc of water, the oxidation rate increased rapidly until about 35 cc of oxygen at standard conditions per gram of thiophenol was consumed. This demonstrates that approximately 70% of the thiophenol had been oxidized over a period of about 55 minutes. Run B seems to indicate that at least a certain level of free water is necessary for a significant rate of oxidation to occur in the absence of an added alkaline reagent.

In the third run, hereinafter Run C, 50 cc of isooctane, 0.1 gram of the hereinabove described charcoal-supported catalyst, 2 cc of thiophenol and 0.08 gram of molecular sieve Type 5A were charged to the laboratory apparatus. The reaction zone was maintained at the same temperature and pressure conditions as in both Runs A and B. The oxygen consumption was recorded as a function of time and these results are presented in the drawing and identified as Run C which illustrates a preferred embodiment of the present invention. From the curve representing Run C in the drawing, it is observed that the initial rate of thiophenol oxidation is very rapid during the first twenty minutes and the total oxygen consumption increases to 37 cc of oxygen at standard conditions per gram of thiophenol after 40 minutes. The degree of hydrogen consumption indicates that 74% of the thiophenol had been oxidized in less than about 40 minutes. Therefore, the use of an admixture of a metal chelate mercaptan oxidation catalyst and a proper amount of desiccant to oxidize mercaptans provides a vastly superior hydrocarbon sweetening process as can readily be seen by comparing the prior art process represented by the Run A curve with the process of the present invention represented by the Run C curve. More particularly, the present invention provides a 30 percent greater oxidation of thiophenol during the first 30 minutes of the reaction compared with the prior art process.

The foregoing description, drawing and example clearly demonstrate the improvements of the present invention and the advantages to be enjoyed from the use thereof.

I claim as my invention:

1. A process for sweetening a sour hydrocarbon fraction containing mercaptan which comprises reacting mercaptans contained in said hydrocarbon fraction with an oxidizing agent by passing said hydrocarbon fraction and said oxidizing agent into contact with a heterogeneous admixture of a supported metal chelate mercaptan oxidation catalyst and a solid desiccant, said desiccant being a component of said admixture in addition to the support for said catalyst.

2. The process of claim 1 wherein said sour hydrocarbon fraction is gasoline.

3. The process of claim 1 wherein said sour hydrocarbon fraction is kerosene.

4. The process of claim 1 wherein said oxidizing agent is air.

5. The process of claim 1 wherein said solid desiccant comprises a zeolite.

6. The process of claim 1 wherein said supported metal chelate mercaptan oxidation catalyst comprises cobalt phthalocyanine sulfonate.

7. The process of claim 1 wherein said supported metal chelate mercaptan oxidation catalyst is supported on a carbon carrier material.

8. The process of claim 1 wherein said supported metal chelate mercaptan oxidation catalyst is supported on an inorganic oxide carrier material.

9. The process of claim 1 wherein said supported metal chelate mercaptan oxidation catalyst comprises a quaternary ammonium salt.

10. The process of claim 1 wherein said sweetening is conducted at conditions which include a temperature from about ambient to about 300° F., a pressure from about atmospheric to about 1000 psig and a liquid hourly space velocity from about 0.5 to about 15.

11. The process of claim 1 wherein said sweetening is conducted in the absence of an alkaline reagent.

* * * * *